United States Patent [19]

Levinstein et al.

[11] 4,023,252

[45] May 17, 1977

[54] CLEARANCE CONTROL THROUGH A NICKEL-GRAPHITE/ALUMINUM COPPER-BASE ALLOY POWDER MIXTURE

[75] Inventors: Moses A. Levinstein; Edward J. Bauersfeld, both of Cincinnati, Ohio

[73] Assignee: General Electric Company, Cincinnati, Ohio

[22] Filed: Dec. 12, 1975

[21] Appl. No.: 640,324

[52] U.S. Cl. ..... 428/650; 75/.5 R; 75/252; 277/96; 418/178; 428/933; 428/610

[51] Int. Cl.[2] ..... B22F 3/00; B22F 1/00

[58] Field of Search ..... 75/208 R, 201, .5 R; 29/182.3, 182.5; 277/96; 418/178

[56] References Cited

UNITED STATES PATENTS

| | | | |
|---|---|---|---|
| 3,068,016 | 12/1962 | Dega | 29/182.3 |
| 3,268,997 | 8/1966 | Miller | 75/222 |
| 3,343,953 | 9/1967 | Schladitz | 75/201 |
| 3,350,178 | 10/1967 | Miller | 29/182.3 |

*Primary Examiner*—Brooks H. Hunt
*Attorney, Agent, or Firm*—Lee H. Sachs; Derek P. Lawrence

[57] ABSTRACT

An improved abradable coating particularly useful to control clearances between relatively moving members in a sealing relationship includes a base portion and an abradable coating portion which is the fusion and interaction product of a mechanical mixture of a plurality of powdered materials comprising a nickel-graphite powder and an aluminum-copper base alloy powder.

4 Claims, 2 Drawing Figures

CLEARANCE CONTROL THROUGH A NICKEL-GRAPHITE/ALUMINUM COPPER-BASE ALLOY POWDER MIXTURE

BACKGROUND OF THE INVENTION

This invention relates to abradable clearance control coatings and, more particularly, to such coatings as are capable of operating up to about 1200° F (650° C).

The efficiency of an axial-flow compressor in a gas turbine engine is at least partially dependent on inhibition of interstage leakage. If a relatively wide clearance exists between a compressor casing and a compressor rotor stage, fluid such as air being compressed can leak from a higher pressure portion to a lower pressure portion of the compressor. Therefore, evolving with gas turbine engine development has been the development of clearance control coatings to minimize interstage leakage.

Solution of such a clearance control problem is made more complex by the fact that during operation, the compressor casing and the rotating compressor blades expand or contract at different rates in an engine cycle. Therefore, one solution has been to allow the blades, rotating, stationary or both, to cut a path into a material mounted in juxtaposition with the blade tips in each stage. Materials so applied have included honeycomb, wire mesh, foamed metals and other porous structures. One such material in wide use in aircraft-type gas turbine engines is described in U.S. Pat. No. 3,342,563 - Butts, issued Sept. 19, 1967, the disclosure of which is incorporated herein by reference.

Many of the existing clearance control systems perform adequately for the type of engine in which they are applied. However, more advanced engines require improved materials having higher temperature capabilities as well as the capability of reducing wear on the tips of blades which rub an abradable coating or material. A more particular problem exists with the wear of blades made from titanium-base alloys.

SUMMARY OF THE INVENTION

It is a principal object of the present invention to provide an improved seal member including an abradable clearance control coating, capable of operating up of about 1200° F (650° C), which coating allows cooperating members such as titanium or titanium-alloy blades to abrade the coating with little if any wear on such cooperating members, and which coating resists erosion produced by airborne particles.

Another object is to provide an improved powdered material for use in providing such a coating.

These and other objects and advantages will be more fully understood from the following detailed description, examples and the drawing, all of which are intended to be typical of rather than in any way limiting on the scope of the present invention.

Briefly, the powdered mixture of the present invention comprises a mechanical mixture of a plurality of powdered materials, each in the size range of about that which will pass through a 150 mesh screen to that which will be retained on a 325 mesh screen, U.S. Standard Sieve (−150/+325 mesh). The mixture includes a first powder which comprises greater than about 50 to less than about 80% of an aluminum-copper alloy powder consisting essentially of, by weight, 90 – 95% Cu, up to about 2% of elements selected from Fe and Si with the balance Al and incidental impurities.

The balance of the mixture is a second powder of nickel-graphite consisting of a core of graphite, herein identified as Cg, and a shell of Ni such that the Ni comprises greater than about 50% and less than about 75% of the Ni-Cg powder.

Such a mixture can be used in providing a coating for a seal member according to the method which flame deposits the powdered mixture on a cleaned base portion of the seal member using an oxy-alkane gas, such as oxy-acetylene gas, under carburizing conditions to heat the powder in the range of about 2000°– 2000° F (1090° – 1205° C).

Resulting from the method which uses the powder associated with the present invention is a seal member which includes a base portion and an abradable coating portion produced from the fusion and interaction of the above-described powder mixture. the abradable coating portion comrpises a dispersion of Cg particles and a plurality of blocky portions of an Al-Cu base alloy wherein Ni platelets aid in the particle-to-particle bonding. The coating portion has a density of about 3.6 – 4.0 grams per cubic centimeter. The base portion can be of any compatible material, such as the Fe—, Co—, Ni—, Ti—, Al— and Mg-base alloys, frequently used in gas turbine engines.

DESCRIPTION OF THE PREFERRED EMBODIMENTS

Figure 1:
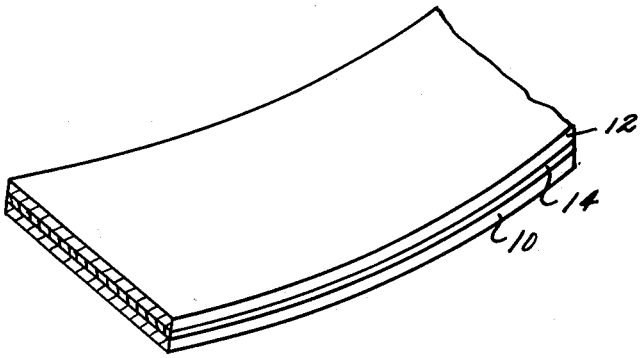
FIG. 1 is a partially sectional perspective view of a shroud seal portion for a gas turbine engine compressor.

The search for improved clearance control coatings or materials for use with cooperating members and compressors, for example rotating blades and casings as well as stationary blades and the rotating portion of rotors, included evaluation of a wide variety of materials generated from commercially available metallic powders. For example, there are commercially available a variety of powders consisting of the core of Cg and a shell of Ni in a variety of composition ranges. The preparation and application of such coated powders, which are sometimes referred to as composite powders, are well known and widely reported in the literature, as identified in column 2 of the above-incorporated U.S. patent. The present invention recognizes that a mechanical mixture of a plurality of powders including the Al-Cu-base alloy powder and the Ni-Cg powder, when applied by a relatively low temperature, low particle velocity flame deposition process in which the particles are heated under carburizing conditions within the range of about 2000° – 2200° F (about 1090° – 1205° C) and preferably about 2020° – 2100° F (about 1100° – 1155° C), results in an improved abradable coating portion for application to a seal member particularly useful in connection with cooperating Ti or Ti-base alloy members. Such a combustion-type or flame-spray process is included in the subject of the concurrently filed application Ser. No. 640,325 entitled "Thermal Spraying of Particles," the disclosure of which is incorporated herein by reference. Such a combustion-type process is contrasted with the plasma deposition process in that significantly different microstructure results: such improved process employed with the present invention showed considerably less laminar particles than those deposited by the plasma process. The method associated with the present invention uses an oxy-alkane-type of gas, typical examples of which are oxy-acetylene gas and oxy-propane gas, applied under carburizing conditions to provide a particle temperature in the range of 2000° – 2200° F (1090°– 1205° C).

An evaluation of the mechanical mixture of a Ni-Cr-base alloy composite powder, one form of which is called Metco 443 powder, and the above-described composite Ni-Cg powder is described in concurrently filed application Ser. No. 640,325, entitled "Clearance Control Through a Ni-Graphite/NiCr-Base Alloy Powder Mixture" and assigned to the assignee of the present invention. In abradability tests conducted at an incursion rate of 1.0 mil per second for 15 seconds using 30 blades in a test rig, blade wear with a 6% Al, 4% V, with the balance Ti, by weight, showed a blade wear of 2 mils or less. Subsequently, when more severe testing was initiated and the number of Ti-alloy blades was reduced to 6, the blade wear increased as shown in the following Table I which includes typical data. Similar data at a rub rate of 0.1 mil per second showed a blade wear of about 11 mils.

TABLE 1

ABRADABILITY SUMMARY

Ti-6%Al-4%V alloy blades
70–75% (Metco 443 powder)/25–30% Ni-Cg powder
(60% Ni-40% Cg) RUB RATE: 1 mil/sec for 15 sec

| Example | No. of Blades | Coating Condition | Blade Wear (mils) |
|---|---|---|---|
| 1 | 30 | A | 1 |
| 2 | 6 | A | 4.5–7 |
| 3 | 6 | B | 7–8 |

A As-sprayed
B As-sprayed and Heat treated at 800° F/5 hrs.

From the data from which Table I was selected, it was concluded that under certain conditions in connection with the use of a Ti-alloy member such as a compressor blade, the use of the above-described mixture of powders could be detrimental under certain conditions.

It was found, according to the present invention, that a mechanical mixture of the above-described Ni-Cg powder with an Al-Cu powder enabled the creation of an abradable material which was significantly less abrasive to Ti alloy blading. In the evaluation of the present invention, it was recognized that about 50 weight percent Al-Cu alloy in the mixture was too soft and lacked sufficient erosion resistance to airborne particles; as high as about 80 weight percent Al-Cu alloy was too hard. Therefore, the mixture of the present invention includes, by weight, greater than about 50 to less than about 80 weight percent of the aluminum-bronze alloy powder, preferably about 55 – 75 weight percent and more specifically about 65 weight percent of the Al-Cu alloy.

In respect to the Al-Cu alloy, the present invention recognizes that up to about 10 weight percent Al with the balance Cu is in the solid solution area of the Cu-Al phase diagram. Within that range, the present invention recognizes the particlar advantage of the composition, by weight, of 90 – 95% Cu, 5 – 10% Al and up to 2% of elements selected from Fe, Si and incidental impurities because of its excellent oxidation resistance to compressor operating temperatures.

In the evaluation of the present invention, each of the powders in the mixture was selected to be in the size range of about —150 to about + 325 mesh (U.S. Standard Sieve) because it was found that a larger size powder would result in a coating of insufficient cohesive strength and a smaller size powder would result in too dense a coating. The various mechanical mixtures of powders evaluated were flame-sprayed onto a base or backing member of a Ti-base alloy using an oxy-acetylene gas mixture under pressure of about 10 – 15 psi. The coating was applied to a thickness in the range of about 0.03 – 0.05 inches.

After generation of abradable coatings with a variety of combinations of such powders, the coating portions were evaluated in rubbing tests employing compressor blades having 0.025 inches thick tips. The blade tips and abradable coating material were rotated relative one to the other at a rate of about 40,000 surface feet per minute for 200 seconds at a rub rate of 0.1 mil/-second. The following Table II presents blade wear data typical of the combination, by weight, of about 65% aluminum-copper and 35% Ni-Cg powders. The aluminum-copper was in the nominal range of, by weight, 90 – 95% Cu, up to about 1% Fe with the balance Al and incidental impurities and the Cg composite powder was, by weight, about 60% Ni and 40% Cg. The data represented by Table II evaluated the relative blade wear under the four conditions shown: as-sprayed; as-sprayed and machined; as-sprayed with heat treatment simulating compressor temperatures and times; and the latter conditions in the machined state.

TABLE II

ABRADABILITY TESTING

65% AlCu alloy/35% NiCg
6 Blades - Ti, 6% Al, 4% V alloy

| Example | Condition | Depth of Rub (mils) | Avg. Blade Wear (mils) |
|---|---|---|---|
| 4 | A | 11 | None |
| 5 | A | 13 | None |
| 6 | A | 16 | None |
| 7 | A | 19 | None |
| 8 | B | 12 | None |
| 9 | B | 14 | None |
| 10 | C | 14 | 1.8 |
| 11 | C | 16 | 0.5 |
| 12 | C | 20 | None |
| 13 | D | 9 | 1.5 |
| 14 | D | 10 | 1.0 |
| 15 | D | 12 | None |
| 16 | D | 12 | 1.0 |

Conditions
A As-sprayed
B As-sprayed and machined
C As-sprayed and heat treated at 900° F for 24 hours
D Condition C and then machined The data of Table II clearly shows the excellent abradability of the 65% AlCu/35% NiCg composition in a variety of conditions when interacting with titanium rubbing members. Other evaluations have shown the powder mixture of the present invention, when made into seal members for use with cooperating members made of alloys based on Fe or Ni, show little or no blade wear in the as-sprayed condition or conditions simulating compressor exposure temperatures and times. Typical of these data are those shown in the following Table III. In Table III, the number of blades and rub rate was the same as that used to generate the data of Table II.

TABLE III

ABRADABILITY TESTING

65% AlCu alloy/35% NiCg
6 Blades of Fe- or Ni-base alloys
RUB RATE: 0.1 mil/sec for 200 seconds

| Example | Alloy | Condition | Depth of Rub (mils) | Blade Wear (mils) |
|---|---|---|---|---|
| 17 | IN718 | A | 18 | None |
| 18 | IN718 | A | 23 | None |
| 19 | IN718 | B | 18 | None |
| 20 | IN718 | C | 20 | None |
| 21 | IN718 | D | 8 | 1.0 |
| 22 | IN718 | D | 14 | None |
| 23 | IN718 | D | 18 | None |
| 24 | A286 | A | | 0.5 |
| 25 | A286 | A(oiled) | | None |

Conditions
A As-sprayed
B As-sprayed and machined
C As-sprayed and heat treated at 1200° F for 24 hours
D Condition C and then machined In Table III, the alloy identified as IN718 alloy consisted nominally, by weight, of 0.05% C, 19% Cr, 18% Fe, 3% Mo, 5% of the sum of Cb and Ta, 1% Ti, 0.5% Al with the balance essentially Ni and incidental impurities. The alloy identified as A286 alloy consisted nominally, by weight, of 15% Cr, 25.5% Ni, 1.3% Mo, 2.2% Ti, 0.007% B, 0.3% V, with the balance Fe and incidental impurities.

In previous evaluations more fully described in the above-identified concurrently filed application Ser. No. 640,326, the disclosure of which is incorporated herein by reference, it has been established, particularly in connection with Table II of that application, that a significant increase in blade wear occurs when the nickel content of the Cg powder is increased as high as 75 weight percent. In addition, it has been recognized that including as low as 50 weight percent Ni provides insufficient Ni to produce the required platelet Ni which bonds together the aluminum-copper alloy powder included in the coating of the present invention. Therefore, the Ni-Cg powder of the present invention includes Ni in the range of greater than about 50 to less than about 75% by weight.

Figure 2:
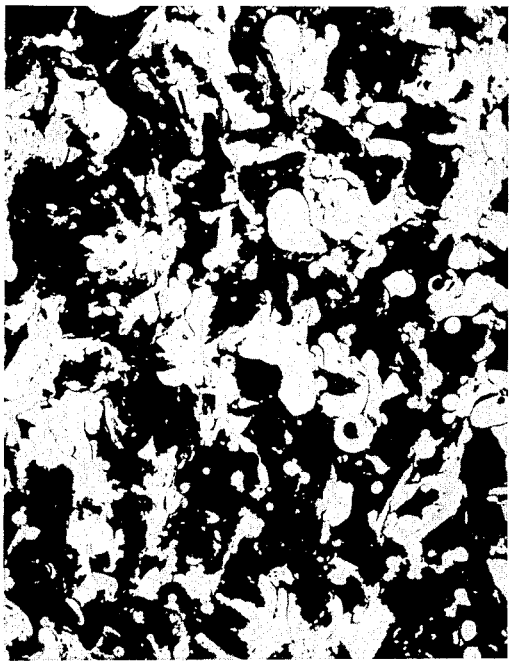
FIG. 2 is a photomicrograph at 100 magnifications of one form of the abradable coating portion of the present invention.

The article associated with the present invention is, in general, a seal member, one type of which is shown in FIG. 1 as a portion of a gas turbine engine compressor shroud. It includes a back-up member or base portion 10 and an abradable coating portion 12 secured with a base portion either directly or through an intermediate strippable portion or bond coating 14, such as is predominantly of Ni. The abradable coating portion 12 is predominantly Cu and is the fusion and interaction product resulting from flame deposition of the powder associated with the present invention. In the coating portion from which the photomicrograph of FIG. 2 was made at 100 X, the coating portion comprises, prior to exposure at operating temperatures, a dispersion of the grainy appearing dark Cg particles, a plurality of the lighter appearing blocky portions of the aluminum-copper alloy primarily bound with platelets of Ni. The coating portion of FIG. 2 was produced as described above from a mixture, by weight, of 65% Al-Cu alloy (90 – 95% Cu, up to 1% Fe with the balance Al and incidental impurities) and 35% Ni-Cg powder, with the Ni comprising about 60% of the Ni-Cg powder.

The present invention has been described in connection with specific examples and embodiments. However, it will be understood and appreciated by those skilled in the art involved that the present invention is capable of variations and modifications, depending upon the particular application desired, without departing from the scope of the invention. It is intended to define such scope by the appended claims.

What is claimed is:

1. A mechanical mixture of a plurality of powdered materials each in the size range of about −150/+ 325 mesh (U.S. Standard Sieve), the mixture comprising, by weight:

greater than about 50% to less than about 80% of an aluminum-copper solid solution alloy powder consisting essentially of, by weight, 90 – 95% Cu, up to 2% of elements selected from the group consisting of Fe and Si, with the balance Al and incidental impurities; and the balance a nickel-graphite powder consisting essentially of a core of graphite and a shell of nickel, the nickel comprising, by weight, greater than about 50 and less than about 75% of the nickel-graphite powder.

2. The mixture of claim 1 in which the aluminum-copper powder is about 55 – 75 weight percent of the mixture.

3. The mixture of claim 2 in which the aluminum-copper powder is about 65 weight percent of the mixture.

4. A seal member including:

a base portion; and an abradable coating portion which is the fusion and interaction product of the mixture of claim 1, secured with the base portion, the coating portion comprising a dispersion of graphite particles, a plurality of blocky particles of an aluminum-copper alloy primarily bound with platelets of nickel, the coating portion having a density of about 3.6 – 4.0 grams per cubic centimeter.

* * * * *